United States Patent [19]

Russo

[11] Patent Number: 4,840,049

[45] Date of Patent: Jun. 20, 1989

[54] PLUNGER LOCK AND KEY

[75] Inventor: Onofrio N. Russo, Middle Village, N.Y.

[73] Assignee: Gas Energy, Inc., Brooklyn, N.Y.

[21] Appl. No.: 911,767

[22] Filed: Sep. 26, 1986

[51] Int. Cl.[4] ..... E05B 67/36

[52] U.S. Cl. ..... 70/34; 70/38 R; 70/38 C; 70/14; 70/386; 70/395

[58] Field of Search ..... 70/34, 38 C, 38 R, 166, 70/176, 386, 395, 14

[56] References Cited

U.S. PATENT DOCUMENTS

| | | | |
|---|---|---|---|
| 3,002,368 | 10/1961 | Moberg | 70/14 |
| 3,033,016 | 5/1962 | Moberg | 70/14 X |
| 3,186,196 | 6/1965 | Moberg | 70/386 X |
| 3,446,045 | 5/1969 | Finck, Jr. | 70/386 X |
| 3,478,548 | 11/1969 | Finck, Jr. | 70/386 X |
| 4,040,279 | 8/1977 | Signorelli et al. | 70/34 |
| 4,155,232 | 5/1979 | Haus, Jr. et al. | 70/395 X |
| 4,252,006 | 2/1981 | Swisher | 70/386 X |
| 4,296,616 | 10/1981 | Guiler | 70/34 |
| 4,394,820 | 7/1983 | Swisher | 70/386 X |
| 4,426,860 | 1/1984 | Swisher | 70/34 |
| 4,441,343 | 4/1984 | Nielsen, Jr. et al. | 70/386 X |
| 4,492,100 | 1/1985 | Swisher | 70/386 X |
| 4,513,591 | 4/1985 | Carlson et al. | 70/386 X |
| 4,513,592 | 4/1985 | Agbay | 70/386 X |
| 4,519,225 | 5/1985 | Simmler et al. | 70/34 |
| 4,543,807 | 10/1985 | Swisher | 70/386 X |
| 4,614,097 | 9/1986 | Signorelli | 70/395 X |
| 4,635,452 | 1/1987 | Agbay | 70/386 X |

*Primary Examiner*—Robert L. Wolfe
*Assistant Examiner*—Suzanne L. Dino
*Attorney, Agent, or Firm*—Fitzpatrick, Cella, Harper & Scinto

[57] ABSTRACT

A plunger type lock has an elongate shank or housing with an enlarged head at one end and at least one lock element movable to project from the housing to engage a grooved or recessed member and lock the same to the housing and to retract into the housing to release the grooved or recessed member, a plunger movable in the housing by a special key to control the position of the lock element and an immovable security rod extending through the plunger and axially substantially to the end of the housing through which the key enters. Due to the presence of the security rod, a special key is required to operate the lock.

16 Claims, 3 Drawing Sheets

PLUNGER LOCK AND KEY

BACKGROUND OF THE INVENTION

1. Field of the Invention

This invention relates to a plunger lock of the type having an elongate shank or housing with an enlarged head at one end and at least one lock element movable to project from the housing to engage a grooved or recessed member and lock the same to the housing and to retract into the housing to release the grooved or recessed member, and to a key for operating the lock.

2. Description of the Prior Art

It is known from U.S. Pat. No. 3,033,016 to provide a lock of the class described to hold in locked relationship two members having apertures which may be moved into alignment. The housing of the lock may be inserted through the apertures and a cap having an internal groove may be applied endwise over the housing so that the lock element can enter the grooves and be retained there until released by action of a suitable key, the head and cap being larger than the apertures.

This patent also discloses a key having two adjacent, projecting fingers so formed that when one is moved axially relative to the other, the distal ends of the fingers are spread apart to engage the surface of the bore of a lock operating member to shift the same against a spring force to unlocking position.

U.S. Pat. No. 3,002,368 discloses a similar lock wherein a plunger 52 axially movable in the housing to project or release lock elements 36 relative to the housing, may tilt relative to plug 58 to engage the same and prevent unauthorized retraction and release of elements 36, as shown in FIG. 4.

U.S. Pat. Nos. 3,554,218 and 3,560,130 and application Ser. No. 661,118 filed Oct. 15, 1984 are of interest and disclose various ways in which locks of the class described can be used. Thus, it will be noted that a cup shaped head can be locked to the end of the plunger type lock to secure valve parts against relative movement as in FIG. 2 of U.S. Pat. No. 3,554,218 or the ball bearings may engage recesses in one of the parts so that a head is not necessary, as in FIGS. 1 and 4 of U.S. Pat. No. 3,560,130. In another application, as in FIG. 7 of the last-integrated with one of the valve parts.

Another lock disclosed in U.S. Pat. No. 4,519,225 uses a center pin 68 with an enlarged head 70 at its front end and a rearwardly extending shaft 72 extending through a bore 58 in the plunger 44. This pin head 70 fits slidingly in barrel bore 34. A friction producing compound is placed in the closed front end of barrel 22 to hold the head against easy movement in the barrel when an authorized key is used to retract the plunger 44, the compound exerting sufficient frictional force on head 70 to prevent axial movement of the pin 68. On the other hand, when an unauthorized device is forced into bore 56 it becomes impaled on pin 68 which moves with plunger 44 causing head 70 to position itself beneath lock members 16 holding them projected and the device in locked condition.

A barrel lock which uses a similar headed pin and a friction producing compound is disclosed in U.S. Pat. No. 4,513,592 and other disclosures of interest will be found in U.S. Pat. Nos. 3,835,674, 4,015,456, 4,058,992, 4,015,456 and 4,543,807.

A commercially available lock known as the Brooks Barrel Lock manufactured by G. J. Brooks company is shown in FIG. 1 of the drawing and will be explained later.

Thus, it will be appreciated that a number of attempts have been made to improve the security of locks of the class described. Nevertheless, the locks disclosed in the foregoing patents can be defeated by jamming a nail or the like into the area of the bore in the plunger to wedge the nail in the bore sufficiently to withdraw the plunger and unlock the device. U.S. Pat. No. 4,543,807, discusses methods sometimes used to defeat a lock of the class described. One such method involves the use of a quick setting adhesive such as an epoxy or cyano-acrylate and, while the patentee indicates that with his device this method will not succeed because the adhesive will spread out adhering the pin 26 and plunger 22 together, a condition which will prevent the device from unlocking, even in this device this adhesive technique may succeed if an excessive amount of adhesive is not used.

It will also be appreciated that most of the proposed solutions to unauthorized manipulation of locks of the class described involve structure having a relatively large number of parts which leads to high cost of manufacture and assembly.

SUMMARY OF THE INVENTION

I have conceived and contribute by the present invention, a lock of the class described, and a key for operating it, by which I am able to overcome the foregoing difficulties and disadvantages.

For attaining the objectives mentioned above and later to be expressed, a principal characteristic feature of my invention resides in a lock of the class described which includes a housing open at both ends, a lock operating plunger axially movable in the housing and biased in a first axial direction therein to locking position, the plunger having an axial through bore, and further including tool engageable means, and security means fixed relative to the housing and extending through the bore in the plunger in a second axial direction toward an end of the housing. The security means may conveniently be fixed to one end of the housing to close the same and may extend substantially to the other end of the housing.

I also provide the interior of the housing and the exterior of the plunger with respective facing shoulders to limit movement of the plunger in the first axial direction to its locking position and I counterbore the plunger bore to provide an annular surface which constitutes the tool engageable means.

The security means include an elongate member having a portion extending axially of the plunger bore and a portion of reduced cross sectional area extending axially through the counterbore.

The lock means may take the form of one or more ball bearings and an equal number of radial openings in the housing to accommodate the bearings for radial movement between locking position projecting from the housing and unlocking position retracted into the housing, the position of the bearings being determined by the axial position of the plunger in the housing. Spring means are provided in the housing to bias the plunger to locking position.

As mentioned, I also contribute a key for operating the lock. Such a key is similar to that described in U.S. Pat. No. 3,033,016 but is structured so that the fingers receive the distal end of the security means as the key is inserted into the lock. Thus, the key includes a housing, a plurality of relatively slidable finger elements carried partly in the housing and having integral, flexible fingers projecting from the housing and having facing surfaces. The fingers are in intimate side by-side relationship and I form a semi tubular recess in each facing surface of the fingers, the recesses extending lengthwise of the fingers.

The fingers are adapted to enter the bore in the plunger, the facing recesses in the fingers defining a passage for receiving the elongate stem of the security means. Spreading means associated with the fingers coact with the fingers to spread them apart, in response to the relative sliding movement of the finger elements, into firm frictional engagement with wall portions of the plunger counterbore while yieldable means coact with the key housing and the finger elements to urge the fingers outwardly relative to that housing.

Manually operable means project from the key housing and coact with the finger elements to slide the latter relative to one another and to impart a retracting movement to the fingers, when they are spread, to cause movement of the lock's operating member or plunger toward its unlocking position.

Actually, the spreading means comprise a wedge formation at the end of at least one of the fingers to coact with the other finger upon relative longitudinal movement of the fingers, to spread the fingers apart and the manually operable means are adapted to impart that relative longitudinal movement to the fingers.

There has thus been outlined rather broadly the the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

DESCRIPTION OF THE DRAWINGS

Specific embodiments of the invention have been chosen for purposes of illustration and description, and are shown in the accompanying drawings, forming a part of the specification wherein.

DESCRIPTION OF THE PREFERRED EMBODIMENTS

Figure 1:
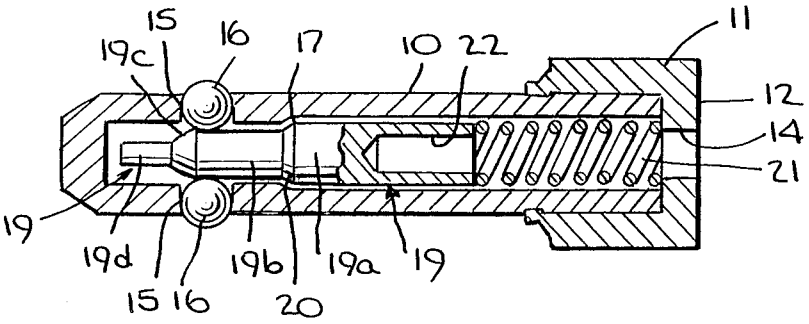
Fig. 1. Prior Art
FIGS. 1 and 2 are longitudinal cross sectional views of a known lock in locking and unlocking positions, respectively.

Referring now to FIG. 1 of the drawing, there is shown a known lock which comprises a tubular housing 10 closed at one end and having a cap 11 fixed to the open end, the cap including an integral end plate 12 centrally apertured as at 14. The housing also has two diametrically opposed radial openings 15 through which lock members such as ball bearings 16 may partially project from the housing and into locking position and may retract into the housing into unlocking position, and also has an internal annular shoulder 17 between sections of reduced diameter and increased diameter.

A plunger 19 has a section **19*a* of a diameter slidingly to engage the section of the housing of large diameter (to the right, as viewed) and a midsection 19*b* of a smaller diameter, an external annular shoulder 20 separating these two sections and, by interfering with shoulder 17, limiting movement of the plunger 19 to the left, as viewed, under the biasing force of a spring 21 extending between the interior of the cap 11 and the end of the large section of the plunger which end is axially bored as at 22**.

Figure 2:
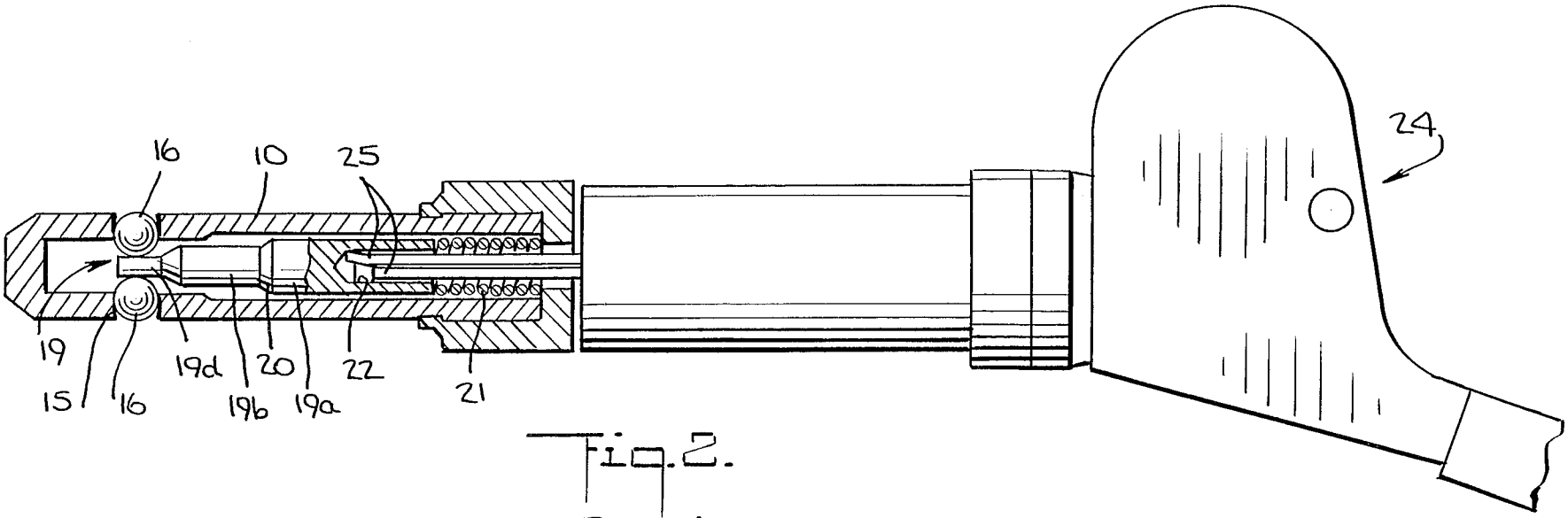
Fig. 2. Prior Art

When the plunger 19 is positioned as shown, that is, in its extreme leftmost position as permitted by interfering shoulders 17 and 20 and under the force of spring 21, the reduced section **19*b* of the plunger forces the ball bearings 16 to project through apertures 15 to locking position. Upon retraction of the plunger 19 against the force of spring 21, as by the action of key 24, whose fingers 25 extend through aperture 14 and into recess 22, as shown in FIG. 2, the ball bearings 16 are permitted to ride down ramp 19*c* of the plunger 19 to a section 19*d* of reduced diameter relative to the diameter of the midsection 19*b*, the bearings thus being allowed to retract from locking position into housing 10. The key 24** may be of a type described in U.S. Pat. No. 3,033,016 and need not be described here.

It will be apparent that such locks are subject to unauthorized manipulation by various means as already alluded to.

Figure 3:
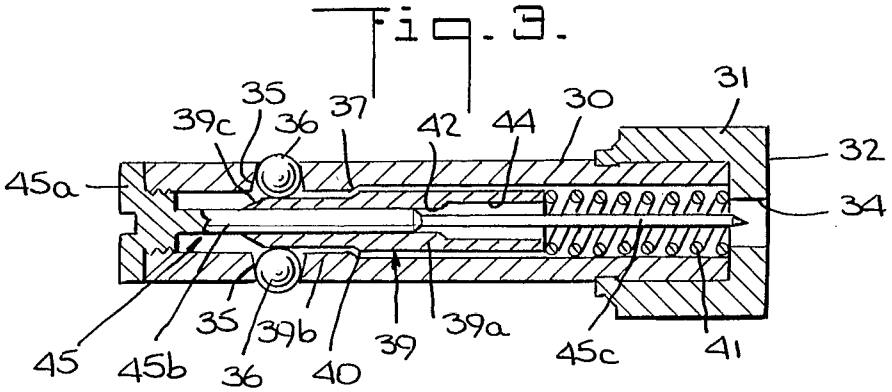
FIG. 3 is a longitudinal cross-sectional view of a lock of the present invention in locking position.
Figure 4:
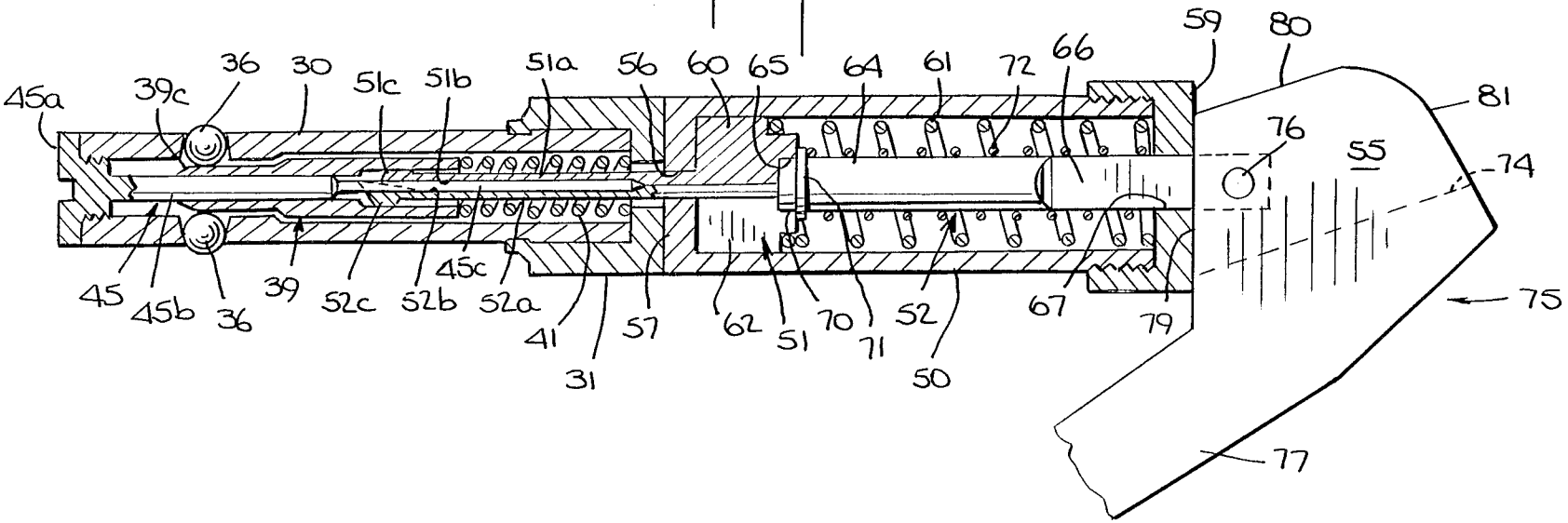
FIG. 4 is a view similar to FIG. 3 but with a key of the present invention inserted into the lock.
Figure 5:
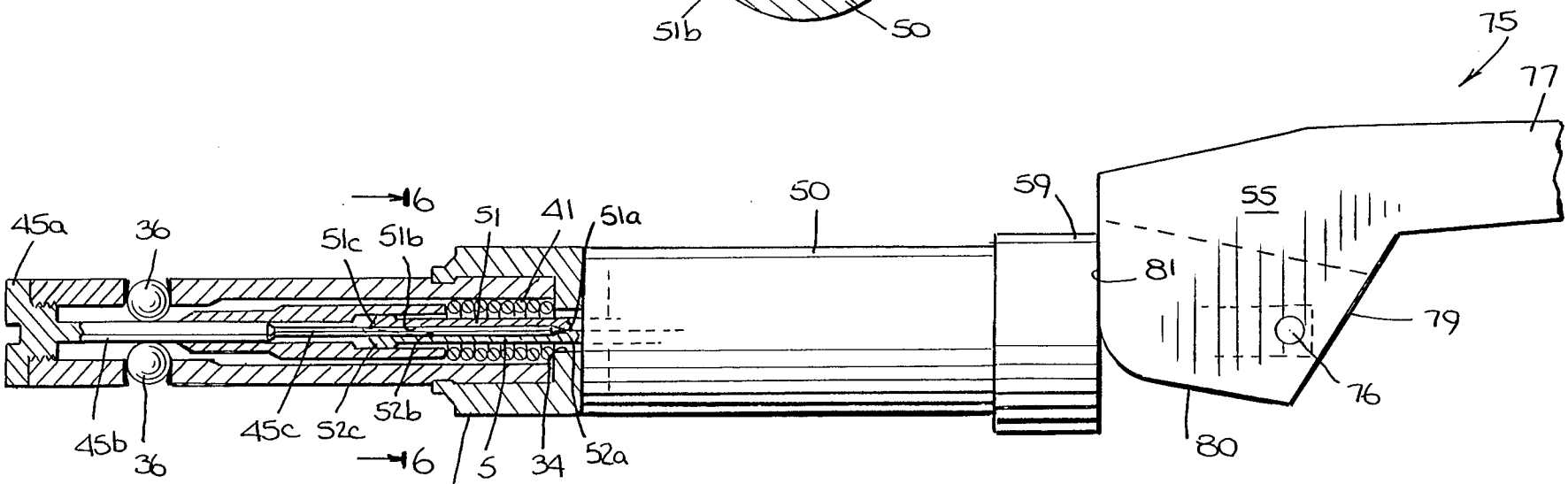
FIG. 5 is a view similar to FIGS. 3 and 4 but showing the lock and key in unlocking position.

Turning now to FIG. 3 to 5, there is shown an embodiment of a plunger lock of the present invention. Thus, FIG. 3 illustrates a lock having a tubular housing 30 open at both ends with a cap 31 similar to the cap 11 of FIGS. 1 and 2 fixed to one end, the cap including an integral end plate 32 centrally apertured as at 34. The housing 30 is also shown with two diametrically opposed radial openings 35 through which lock members such as ball bearings 36 may partially project from the housing into locking position and retract into the housing into unlocking position. The openings 35 may be slightly tapered outwardly as shown, or they may be swaged at their exterior ends to prevent the bearings 36 from falling out of the housing. An internal shoulder 37 is provided in the housing between sections of reduced and increased diameter, the latter extending to the end of the housing supporting the cap 31.

A plunger 39 is similar to plunger 19 described hereinbefore to the extent that it has a section **39*a* of a diameter slidingly to engage the section of the housing of large diameter (to the right as viewed) and a section 39*b* of reduced diameter, an external shoulder 40 separating these two sections and, by interfering with shoulder 37, limiting movement of the plunger 39 to the left, as viewed, under the biasing force of a spring 41 extending between the interior of the cap 31 and the end of the large section of the plunger 39**.

In the present structure, unlike that previously described, the plunger 39 is throughbored as at 42 and counterbored as at 44, at its end adjacent the spring 41. The left end of the plunger terminates at the end of ramp 39c, there being no element similar to section 19d of FIGS. 1 and 2.

My novel plunger lock includes security means in the form of an elongate stem or rod 45 that has a head 45a closing the end of housing 30 opposite keyhole 34. Thus, the head 45a may be threaded into the housing, as shown. The rod is shown in the form of an elongate shank integral with the head and extending axially of the housing. The shank is formed in two sections, the first, 45b dimensioned slidingly to fit in bore 42 of plunger 39 and the second, 45c of reduced cross sectional dimension extending through the coils of spring 42 to terminate in a point just inside the keyhole 34.

It will be appreciated that the security means described above will prevent entry into the housing of key of the type disclosed in U.S. Pat. No. 3,033,016, for example.

Figure 6:
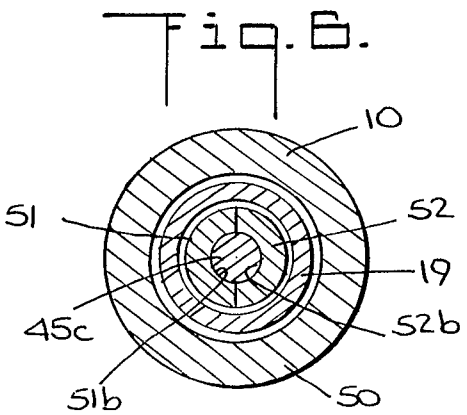
FIG. 6 is a cross sectional view taken along line 6—6 of FIG. 5.

I have therefore modified the disclosed key so that, as shown in FIGS. 4 and 6, it has a housing 50, plural relatively slidable finger elements 51 and 52 carried partly within the housing and having integral flexible fingers 51a and 52a respectively, projecting from the housing. As shown, the facing surfaces of the fingers are in intimate side by side relationship and semi-tubular recesses 51b and 52b are formed in the respective fingers 52a, 52a, the recesses extending lengthwise thereof and facing one another.

The fingers are adapted to enter the keyhole 34 and the bore 44 of the plunger 39, the recesses 51b and 52b defining a passage for receiving the elongate shank section 45c. Spreading means comprising wedges 51c and 52c are formed on the distal ends of the respective fingers 51a, 52a to coact to spread the fingers apart in response to relative sliding movement of the finger elements 51, 52 so that the fingers move into firm frictional engagement with the wall of the counterbore 44 of the plunger 39, the recesses 51b and 52b extending through the wedges 51c and 52c, respectively.

Yieldable means shown as springs 61, 72 coact with the housing 50 and the finger elements 51 and 52 to urge the fingers 51a and 52a outwardly relative to the housing and manually operable cam member 55 project from the housing and coact with the finger elements to slide the latter relative to one another and to impart a retracting movement to the fingers when the fingers are spread apart, to cause movement of the lock's plunger 39 toward its unlocking position.

It will be understood that, if desired, only one wedge 51c or 52c may be used to spread the fingers although I prefer to use two wedge formations as shown. The fingers 51a and 52a extend upwardly, slidably through an aperture 56 in the lower, flat end 57 of cylindrical housing 50, threaded on the upper end of which is a cap 59. An almost completely circular, integral, enlarged upper end portion 60 of finger 51a is slidable within the housing 50 and spring 61, compressed between the cap 59 and portion 60, normally holds finger 51a in its extended position shown in FIG. 4.

Finger 52a extends slidably upwardly through aperture 56 and also through a slot 62 in portion 60, and has an enlarged plunger-like upper end portion 64 which is eccentric with respect to finger 51a but is concentric to the housing 50. The lower end of portion 64 seats within a recess 65 in the top of portion 60. The upper end of portion 64 is formed as an integral extension 66 of rectangular shape in cross section, and this extension extends upwardly, slidably through a rectangular aperture 67 in the cap 59 and beyond the top surface of the latter. The portion 64 is slightly shouldered as at 70 to support a washer 71, and the coil spring 72, surrounding portion 64 and telescoped within spring 61, is compressed between the washer 71 and the cap 59 to yieldably hold the finger 51a normally in its lowermost non operative position shown in FIG. 4. The upper end of extension 66, protruding above the cap 59 is disposed within a slot 74 in cam member 55 wherein it is pivotally held by a suitable pivot pin or bolt 76. The cam member is shaped substantially as illustrated and has an operating handle 77 and first, second and third cam surfaces, numbered, respectively, 79, 80 and 81, which cooperate with the top surface of cap 59 to operate the fingers 51a and 52a.

When cam member 55 of key 24 is positioned, as in FIG. 4, with cam surface 79 against the flat top of cap 59, the fingers 51a and 52a are in non-wedging or non operative position and the key's fingers may be freely inserted into or removed from a lock of the character disclosed herein. Assuming that the fingers, in their non-wedging positions, have been inserted in a lock to open the latter, and that the bottom of housing 50 abuts the top end of the lock as in FIG. 4, manual turning of the cam member 55 counterclockwise, as viewed, to bring cam surface 80 into intimate contact with cap 59, causes finger 51a to be raised so that the key's fingers are wedged apart to grip tightly the inner surface of bore wall 44 of the lock plunger 39. This positively associates the key with the lock, but does nothing more.

Thereafter, to open the lock, the cam member 55 is given a further clockwise movement to bring cam surface 81 into intimate contact with the cap 59, thereby raising the two inter-wedged fingers 51a and 52a concomitantly raising the lock's plunger or operating member 39 from its FIG. 4 position to its FIG. 5 position. This brings the plunger 39 out of contact with the balls 36 to permit the latter to withdraw into housing 30 into unlocking position.

The springs 61 and 72 coact with portions 64 and 66 and with the cam member 55 to cause the latter to remain in whichever of the three described positions to which it may be moved.

Re-closing of the lock involves only the re-application of the key to the lock and turning of the cam member 55 back to the position shown in FIG. 4, whereafter the key readily separates from the lock.

It will be understood that any means for effecting relative axial movement of the fingers to effect the desired spreading thereof followed by axial movement of both fingers together to draw the lock plunger toward unlocking position may be used in lieu of the cam member 55. Thus, one or a pair of laterally extending operating arms connected to the end portion 64 by suitable pins extending out of the housing 50 through axial slots formed therein as shown in FIGS. 3 and 6 of U.S. Pat. No. 3,033,016 may be used to effect operation of the semi-tubular recessed fingers already described.

From the foregoing description it will be seen that I contribute an improved plunger lock and key therefor which is substantially more secure against tampering or unauthorized manipulation than previously known devices of the class here described. Thus, in the present construction, since the security rod extends substantially the entire length of the lock, it will be extremely difficult to force a solid object such as a nail or the like into the plunger. Moreover, the plunger is through bored and therefore is opened at both ends and the security rod extends through the entire length of the bore so that if a piece of tubing is jammed into the plunger, the tubing will lock onto the immovable security rod so that, even if it also locks onto the plunger, the combination will not move.

If a quick acting adhesive, such as those mentioned, is used, the plunger will be cemented to the immovable security rod so that, again, it will not be possible to withdraw the plunger.

I believe that the construction and operation of my novel improved plunger lock and key will now be understood and that the several advantages thereof will be fully appreciated by those persons skilled in the art.

I claim:

1. An improved plunger lock, comprising:
a housing open at both ends;
a lock operating plunger axially moveable in said housing and biased in a first axial direction therein to locking position, said plunger having an axial bore extending there through said plunger further including tool-engagable means; and
security means fixedly mounted against movement relative to said housing and extending through said bore in said plunger in a second axial direction toward an end of said housing.

2. A lock according to claim 1, wherein said security means is fixed to one end of said housing and closes the same, and extends substantially to the other end of said housing.

3. A lock according to claim 1 or 2, wherein the interior of said housing and the exterior of said plunger are formed with respective facing shoulders to limit movement of said plunger in the first axial direction to its locking position.

4. A lock according to claim 1 or 2, wherein said bore in said plunger is counterbored to provide an annular surface constituting said tool engageable means.

5. A lock according to claim 4, wherein said security means includes an elongate member having a portion extending axially of said bore in said plunger and a portion of reduced cross sectional area extending axially through said counterbore in said plunger.

6. A lock according to claim 5, wherein said plunger is biased to locking position by a helical coil spring in said housing.

7. An improved plunger lock, comprising:
a housing open at both ends and having at least one radial opening therein;
lock means movable in said at least one radial opening between a locking position projecting therefrom and a non-locking, non-projecting position;
a lock means operating plunger axially moveable in said housing to project said lock means when in one position and to permit said lock means to assume a non-locking, non-projecting position when in a second position, and having an axial bore extending there through and providing tool-engagable means;
a cover closing one end of said housing but having a keyhole therein for admitting a tool adapted to engage said tool-engagable means;
spring means biasing said plunger to locking position; and
security means fixedly mounted against movement relative to said housing and closing the other end of said housing, said security means extending through said bore in said plunger in a direction toward said one end of said housing.

8. A lock according to claim 7, wherein said spring means bears against the inner surface of said cover and the adjacent end of said plunger.

9. A lock according to claim 7 or 8, wherein said tool-engageable means is constituted by a counterbore in said plunger and said security means includes a head closing said other end of said housing and an elongate stem having a portion extending axially of said bore in said plunger and a portion of reduced cross-sectional area extending axially through said counterbore and spaced inwardly of said tool-engageable means in said plunger.

10. A key for opening a lock which has a slidable operating member which is yieldably biased toward locking position and has a bore extending there through and a security member including an elongate stem extending axially through said bore, said key comprising a housing, plural, relatively slidable finger elements carried partly within said housing and having integral flexible fingers projecting from said housing and having facing surfaces in intimate side-by-side relationship and a facing semi-tubular recess in each of said fingers extending lengthwise of said fingers, said fingers being adapted to enter said bore and said facing recesses defining a passage for receiving said elongate stem, spreading means adapted to coact with said fingers for spreading the latter apart, in response to relative sliding movement of said finger elements, each of said fingers being displaced directly into firm frictional engagement with wall portions of said bore, yieldable means coacting with said housing and said finger elements to urge said fingers outwardly relatively to said housing and manually operable means projecting from said housing and coacting with said finger elements relatively to slide the latter and to impart a retracting movement to said fingers, when the latter are thus spread, to cause movement of the lock's said operating member toward its unlocking position while allowing said elongate stem to maintain a fixed relationship with said lock and to pass through said passage defined by said facing recesses.

11. A key according to claim 10, said spreading means comprising a wedge formation at the end of at least one of said fingers and arranged to coact with another of said fingers, upon relative longitudinal movement of said one and other of the fingers, to spread said fingers apart, and said manually operable means being adapted to impart said relative longitudinal movement to said fingers.

12. A key according to claim 11, said manually operable means including a manipulatable projection, connected with one of said fingers and accessible at the exterior of the key for manipulation to move the finger connected to it, relatively to another of said fingers and thereby spread said fingers apart; and said projection being further manipulatable, after said spreading of the fingers, to move said fingers and said operating member, gripped by said fingers, toward said member's unlocking position.

13. A key according to claim 12, said projection extending laterally, relative to said fingers, to the exterior of the key.

14. A key according to claim 12, said projection extending endwisely, relative to said fingers, to the exterior of the key.

15. A key according to claim 14, said key including a manually operable cam pivotally connected to the outer end of said projection and coacting with an adjacent portion of said housing to actuate said projection.

16. A key according to claim 15, said cam having different surfaces coacting with said housing to position said projection and the finger connected thereto in three different positions in which, (1) said fingers are unspread, (2) said fingers are spread apart and (3) said fingers are firmly engaged within the lock's operating member and the latter is in its unlocking position.

* * * * *

UNITED STATES PATENT AND TRADEMARK OFFICE

CERTIFICATE OF CORRECTION

PATENT NO. : 4,840,049

DATED : June 20, 1989

INVENTOR(S) : ONOFRIO N. RUSSO

It is certified that error appears in the above-identified patent and that said Letters Patent is hereby corrected as shown below:

COLUMN 1, line 46, "last-integrated" should read --last-mentioned patent, the cap may be imbedded and integrated--.

COLUMN 3, line 5, "semi tubular" should read --semi-tubular--.

COLUMN 5, line 26, "52a" (first occurrence) should read --51a--;

line 50, "The" should begin a new paragraph.

COLUMN 6, line 6, "The" should begin a new paragraph;

lines 17-18, "non operative" should read --non-operative--;

line 31, "clockwise" should read --counterclockwise--;

line 33, "52a" should read --52a and--.

Signed and Sealed this

Twentieth Day of March, 1990

*Attest:*

JEFFREY M. SAMUELS

*Attesting Officer*

*Acting Commissioner of Patents and Trademarks*